US006334595B1

(12) United States Patent
Stenkvist et al.

(10) Patent No.: US 6,334,595 B1
(45) Date of Patent: Jan. 1, 2002

(54) DEVICE FOR SUPPORTING A HAND-HELD TOOL

(75) Inventors: Sivert Stenkvist, Torshälla; Juhani Marttiin, Kungsör, both of (SE)

(73) Assignee: Car-O-Liner AB, Kungsor (SE)

( * ) Notice: Subject to any disclaimer, the term of this patent is extended or adjusted under 35 U.S.C. 154(b) by 0 days.

(21) Appl. No.: 09/473,878

(22) Filed: Dec. 29, 1999

(51) Int. Cl.[7] ..... A47F 5/00

(52) U.S. Cl. ..... 248/125.2; 248/123.2; 248/176.1; 248/283.1; 248/589; 248/586

(58) Field of Search ..... 248/125.2, 123.11, 248/123.2, 176.1, 280.11, 283.1, 589, 586

(56) References Cited

U.S. PATENT DOCUMENTS 3,345,461 A * 10/1967 Bunting ..... 178/7.81
3,417,953 A * 12/1968 Hillquist et al. ..... 248/280
4,266,747 A * 5/1981 Souder, Jr. et al. ..... 248/280.1
4,863,133 A * 9/1989 Bonnell ..... 248/278
4,881,709 A * 11/1989 Nakamura ..... 248/281.1
5,213,292 A * 5/1993 Evans ..... 248/123.1
5,609,316 A * 3/1997 Tigliev ..... 248/123.11
5,746,404 A * 5/1998 Merko ..... 248/123.11
6,070,839 A * 6/2000 Brenner et al. ..... 248/123.11
6,105,909 A * 8/2000 Wirth et al. ..... 248/123.2

* cited by examiner

*Primary Examiner*—Ramon O. Ramirez
*Assistant Examiner*—A. Joseph Wujciak
(74) *Attorney, Agent, or Firm*—Sughrue Mion, PLLC

(57) ABSTRACT

The present invention relates to a device for supporting a heavier hand-held tool, particularly a spot welding gun, comprising a tool stand provided with a support arm arrangement mounted thereon, and a constant force spring having a first end and a second end, said first end of the constant force spring being attached to said support arm arrangement, and said hand-held tool being hung from said second end of the constant force spring, wherein the constant force of the spring is such that a user of the hand-held tool is relieved from at least a substantial portion of the weight of the tool, and the drawn-out length of the spring is long enough to enable the tool to be hung in a plurality of different operation heights. Preferably, the constant force of the spring is such that the tool is hung in a weight-balanced state. A line element may be connected between the constant force spring and the tool.

17 Claims, 2 Drawing Sheets

DEVICE FOR SUPPORTING A HAND-HELD TOOL

TECHNICAL FIELD

The present invention relates to a device for supporting a heavier hand-held tool, particularly a machine-driven tool such as a spot welding gun intended to be used for e.g. plate works, such as repairs of car bodies or the like, and optionally for supporting cables attached to said tool.

The present invention is applicable to a large variety of different, preferably heavy, hand-held tools, but in the following sections hereinbelow, it will mainly be described in relation to spot welding guns.

RELATED ART

A spot welding gun is usable for resistance welding or spot welding, wherein two or several welding objects, are joint together in one or several points.

Resistance welding of this kind may be used for manufacture but more generally it is used for repairs, particularly of car bodies. Resistance welding is in this respect often the most suitable joining method, where it is applicable as regards accessibility. It is a fast and effective method, which provides for stronger welding joints with fewer welding spots than if a MIG-weld or the like is used. Resistance welding using a spot welding gun is furthermore harmless to the environment; for instance the flue gases are severely reduced. Furthermore, the method provides for a low heat release in the plate around the welding spot, which provides for a maintained corrosion resistance of zincified plate, and the thermal stresses in the structures are minimized.

The so-called welding parameters that may be varied during the welding comprise electrode pressure, welding current strength and time, cooling effect, cooling time and hold time.

One of the problems of using a spot welding gun is due to its heaviness, which may limit the use of it. Spot welding includes a number of different operations including positioning the spot welding gun at the objects to be welded, adjusting the electrodes to the point where it is desired to have the weld joint, and also sufficiently close to each other so that the stroke of the cylinder is "sufficient" to attain necessary electrode pressure during welding. Further, the operations include activating compressed air to raise the electrode pressure, applying a welding voltage over the electrodes, holding the gun during the welding processing, turning off the voltage, lowering the electrode pressure and removing the gun.

While positioning the welding gun at the objects to be welded, it may be difficult to pass edges or other obstacles of the welding objects. Typically, this is solved in such a way that it will be possible to release or demount an electrode or an arm of the gun.

All these mentioned operations are to be performed while holding the spot welding gun in the hands. This is hard work for the user and will be tiring if no support is available.

JP 111156557 A (applicant: Toyota Auto Body Co Ltd) depicts a welding gun stand provided with an arm arrangement having an arm tip end to which a welding gun is suspended via a balancer or balancer reel. The arm arrangement permits movement of the arm tip end in the horizontal direction for increasing the moving-around range of the welding gun.

In WO 97/14540 (applicant: Atlas Copco Berema AB) a device for supporting hand-held machine-driven tools, is described. The device includes a harness structure to be carried on the back of a worker, said harness structure having a frame, a tube system and a balancer reel attached thereto. The tube system extends upwardly and forwardly and ends in front of and above the worker, and guides a line element, which in one end is attached to the balancer reel and in which other end the hand-held machine driven tool is suspended. The balancer reel has a setting spring for adjusting the is force exerted on the line element such that the tool is hung in a weight-balanced state.

The balancer reel may be of conventional design and comprises a reeling drum for the line element and a helical setting spring or may be of an improved kind wherein the tension of the spring is kept constant irrespective of the length to which the line element is drawn out. An explicit reference to such an improved balancer is given as U.S. Pat. No. 4,290,564 issued to Karlsson.

Said U.S. patent discloses a spring-operated reversably rotatable body having a conical surface on which a line element or similar can be wound, the body being connected to a coil spring which is stretched by the rotation of the body during winding of the line element. The conical structure of the body surface provides means by which the tensile force caused by the coil spring on the line element during rotation of the body will remain constant. The spring-operated body may further be provided with an adjustment screw for adjusting the shape of the body and thus the tensile force of the spring. It is mentioned that the invention is particularly useful in retractable safety belts to obtain a constant force in the belt strap during extension of the belt.

Thus, according to the prior art, there are needed complex and expensive balancer reels in known supporting devices for counter-acting the weight of a hand-held tool, such as e.g. a spot welding gun. Further, these balancers are bulky, and thus require much space, and they require adjustment of the tensile force.

SUMMARY OF THE INVENTION

It is an object of the present invention to provide a device for supporting a hand-held tool, particularly a machine-driven tool such as a spot welding gun intended to be used for e.g. plate works, such as repairs of car bodies or the like, which is lacking one or several of the problems which occurs using a supporting device according to the prior art.

Thus, it is an object to provide a device, which through an uncomplicated process enables or simplifies the use of a hand-held tool such as a spot welding gun.

A further object of the invention is to provide a device of the kind mentioned above, which is simple, compact, reliable and easy to manufacture.

Yet a further object the invention is to provide such a supporting device, which is easily modifiable to suit hand-held tools of various sizes and weights.

These and other objects are according to one aspect of the invention attained by a device for supporting a heavier hand-held tool comprising a tool stand provided with a support arm arrangement mounted thereon, and a constant force spring having a first end and a second end, said first end of the constant force spring being attached to said support arm arrangement, and said hand-held tool being hung from said second end of the constant force spring, wherein the constant force of the spring is such that a user of the hand-held tool is relieved from at least a substantial portion of the weight of the tool, and the drawn-out length of the spring is long enough to enable the tool to be hung in a plurality of different operation heights.

According to a further aspect of the invention there is provided a device for supporting a heavier hand-held tool, particularly a machine-driven tool such as a spot welding gun intended to be used for e.g. plate works, such as repairs of car bodies or the like, optionally with cables attached to it, comprising a tool stand provided with a support arm arrangement mounted thereon, a constant force spring having a first end and a second end, and a line element having a first end and a second end, said first end of the constant force spring being attached to said support arm arrangement, and said second end of the constant force spring being attached to said first end of the line element, said hand-held tool being arranged to be suspended from said second end of the line element, wherein the constant force of the spring is such that a user of the hand-held tool, during use, is relieved from at least a substantial portion of the weight of the tool, and optionally of the cables attached to it, and the drawn-out length of the spring is long enough to enable the tool to be suspended in a plurality of different operation heights.

According to still a further aspect of the invention there a-s provided a device for supporting cables attached to a heavier hand-held tool, particularly a machine-driven tool, such as a spot welding gun intended to be used for e.g. plate works, such as repairs of car bodies or the like, comprising a tool stand provided with a support arm arrangement mounted thereon, a constant force spring having a first end and a second end, and a line element having a first end and a second end, said first end of the constant force spring being attached to said support arm arrangement, and said second end of The constant force spring being attached to said first end of the line element, said cables attached to the hand-held tool being arranged to be suspended from said second end of the line element, wherein the constant force of the spring is such that a user of the hand-held tool, during use, is relieved from at least a substantial portion of the weight of the cables attached to it, and the drawn-out length of the spring is long enough to enable the cables to be suspended in a plurality of different operation heights.

An advantage of the supporting devices according to the present invention is that they are readily and easily manufactured to a relatively low cost.

A further advantage of the inventive devices are that they are simple and provide for a reliable and effective weight-balancing function.

More advantages and features of the invention will be apparent from the description below.

SHORT DESCRIPTION OF THE DRAWINGS

The invention will be described closer below with reference to FIGS. 1–3, which are only shown in order to illustrate the invention and shall therefore in no circumstances limit the same.

PREFERRED EMBODIMENTS

In the following description, for the purpose of explaining and not limiting the invention, specific details are given, such as particular applications, techniques, etc., in order to give a thorough-understanding of the invention. It shall, however, be apparent for the man skilled in the art that the invention may be practiced in a manifold of other forms than these.

An embodiment of the present invention will be described with reference to FIG. 1, which shows, in a partly exploded perspective view, a supporting device 1 for supporting a heavier hand-held tool, i.e. a spot welding gun 3.

Spot welding gun 3 comprises a substantially cylindrical house 3*a* with handles 3*b* and a C-formed arm 3*c*, at the ends of which two electrodes 3*d*, 3*e* are facing each other. The front electrode 3*e* is preferably firmly mounted and each electrode 3*d*, 3*e* has a rounded and possibly somewhat flattened electrode tip. Spot welding gun is provided with connection for supplying compressed air to achieve a sufficient electrode pressure, electrical connection to the electrodes for supplying the welding voltage and electrical connection for any controlling electronics (none of these connections are shown in FIG. 1). Further description of a preferred spot welding gun to be used with the present invention may be found in our copending international patent application No. PCT/SE99/01438 (RESISTANCE WELDING) filed Aug. 24, 1999, which application hereby is incorporated by reference.

Figure 1:
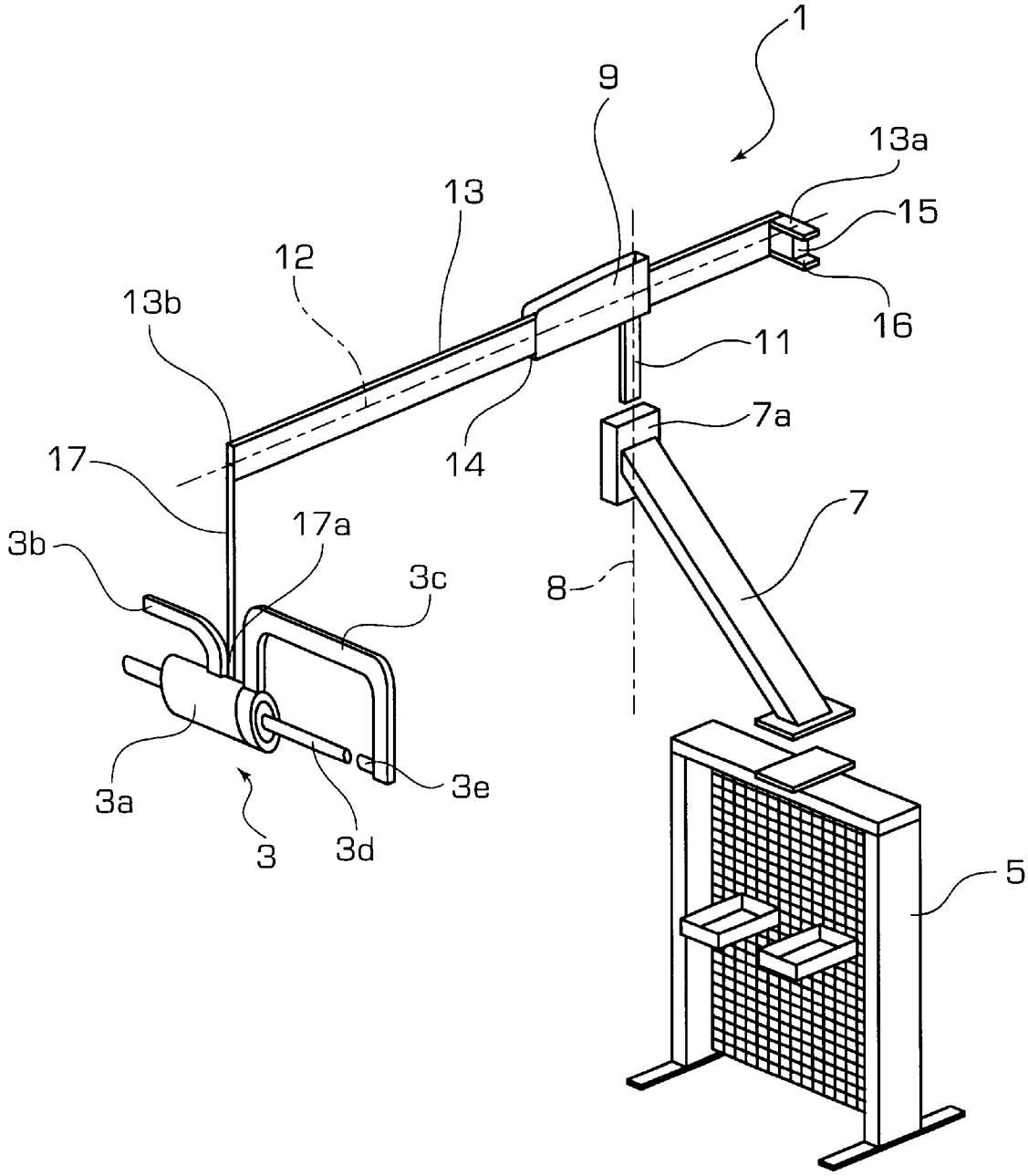
FIG. 1 shows, in a partly exploded perspective view, an embodiment of the present invention.

Device 1 comprises a tool stand 5 which may be mounted on a rack or a trolley, which rack or trolley also may carry further necessary equipment such as a source for compressed air, a power supply source, and controlling electronics (not shown in FIG. 1). On top of stand 5, a support arm 7 is mounted. Preferably, support arm 7 is not completely vertical, but is inclining from vertical axis 8 by a predetermined amount, say 15–40%. If stand 5 is mounted on a trolley or otherwise provided with wheels, arm 7 is preferably firmly mounted on stand 5 as shown in the Figure. If, on the other hand, stand 5 is not easily rotated arm 7 may be mounted on stand 5 such that it is rotatable around the vertical-axis 8.

Arm 7 is provided with a vertically oriented aperture 7*a* at its uppermost end for receiving a pivot 11 provided on a housing 9 such that housing 9 is pivotally movable around a vertical axis. Housing 9 is further provided with a through bore along a horizontal axis 12 for receiving an upper, substantially horizontally oriented, arm 13, which is movable, preferably slidably, along the axis of the bore. Housing 9 may be provided with a bearing, i.e. rolls 14, for facilitating the movement of upper arm 13. In such a manner upper arm 13 is freely moved around a large area by the pivotal movement around vertical axis 8 and a translational "telescopic" movement along horizontal axis 12.

According to the invention, upper arm 13 is in one end 13*a* provided with a constant force spring 15. A suitable constant force spring to be used in the present invention is commercially available from Lesjofors Stockholms Fjäder AB, Vällingby, Sweden as article No. 8080. The inner ring-shaped end of such a constant force spring is rotatably mounted on a shaft 16 or other axis at upper arm 13. Preferably, the outer loose end of spring 15 is slidably guided by and along said upper arm, either within arm 13 or in a channel or groove (not shown). The loose end is further attached to a first end of a line element 17 such as a cord or a wire, which also runs along said upper arm 13 to the other end 13*b* of arm 13 from where it hangs towards the floor by virtue of the gravity. In the second end 17*a* of line 17 spot welding gun 3 is suspended.

The constant force of constant force spring 15 is preferably chosen to balance the weight of spot welding gun 3 together with any occurring cables and wires which add to the weight of spot welding gun 3. The drawn-out length of spring 15 is chosen so as to enable gun 3 to be used in a wide range of operation heights.

Preferably, the constant force spring is easily mounted and demounted so as to allow fast replacement with another spring having another constant force at deflection suitable for another tool or a modified tool.

Figure 2:
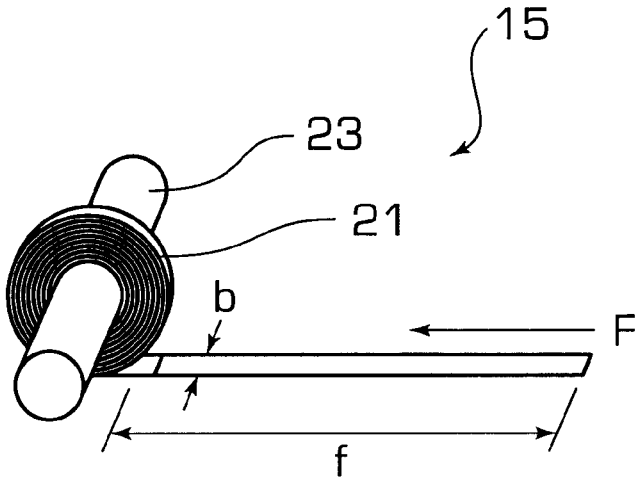
FIG. 2 shows, in a perspective view, a constant force spring as used in the first embodiment of the present inventions.

FIG. 2 shows, in a perspective view, the constant force spring as used in the first embodiment of the present invention in greater detail. 21 denotes the metallic band of the spring and 23 denotes an axis onto which the spring may be mounted. F indicates the constant force at deflection, b is the width of the band and f is the current deflection. The constant-force spring is used for a linear movement and gives an almost constant force at deflection.

The constant force spring consists of a rather stiff or rigid, preferably metallic, band which is typically 3–60 mm wide, 0.05–0.8 mm thick, 100–2000 mm long and made of steel. In its state of rest the band is typically substantially or completely in a rolled-up condition and when being unrolled, i.e. deflected, there arises a tensile force, which is almost constant independently of the rolled-out or unrolled length, i.e. deflection. Typical values of the tensile force is 0.5–100 N, but can be larger.

The constant-force spring should be mounted on a bearing or similar. When a bearing is not going to be used, the shaft diameter chosen should allow sufficient play on the inner diameter, to prevent the spring locking onto the shaft.

The various parameters of the constant force spring are as follows.

t=material thickness (mm)

b=width (mm)

$D_i$=inner diameter (mm)

$D_v$=outer diameter (mm)

s=resilience (max. deflection) (nmn)

F=spring force (N)

The spring having article No. 8080 available from Lesj öfors Stockholms Fjäder AB, Vällingby, Sweden features following data:

t=0.559 mm b=50.8 mm $D_i$=63.7 mm

D*y*=76.0 mm s=1852 mm

F=83.0 N

Max. working temp. 150° C.

Material: Stainless 11R51

Note that the spring may be delivered with an inner diameter below the nominal diameter, therefore the spring may have to be extended or expanded when being mounted on a bearing.

Figure 3:
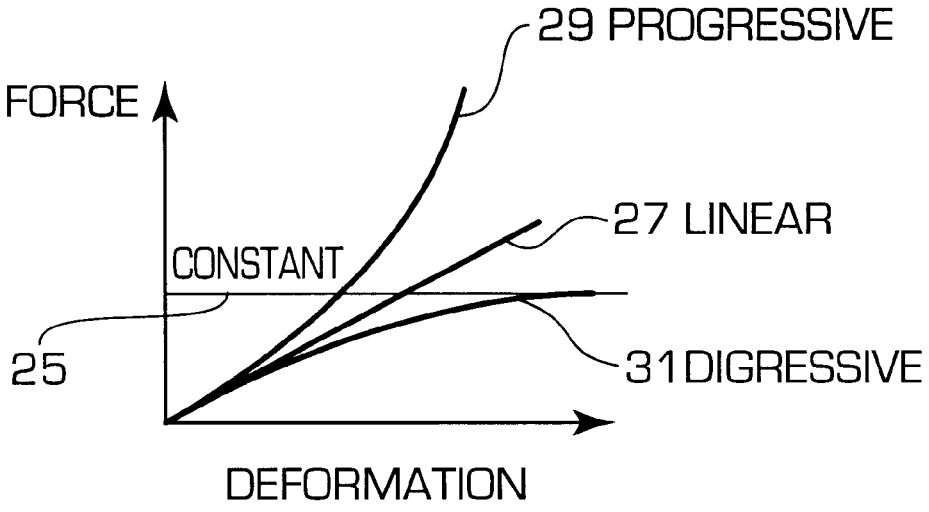
FIG. 3 is a diagram of force versus deformation for different kinds of springs including the constant force spring as used in the present invention.

FIG. 3 is a diagram of force versus deformation for different kinds of springs. The characteristics of the constant force spring as used in the present invention is denoted by 25, whereas the characteristics of other kinds of springs (not used in the present invention) are denoted by 27 for linear springs, 29 for progressive springs and 31 for degressive springs.

The present invention provides for a large moving-around range of the spot welding gun both in horizontal and vertical directions while the arms of the worker are relieved. Hence, the service area of spot welding gun is made large.

The constant force of the spring of the supporting device is chosen in relation to the weight of the hand-held tool and any applicable cables or connections so as to achieve an effective balancing, and preferably a total balancing, of said weight. Note that the arms of the user are relieved also in the cases where the weight of the tool is only partly balanced by the spring. In such instances the "effective weight" of the spot welding gun may be, if not eliminated, at least heavily reduced. The invention covers also cases where the constant force of the spring is larger than the weight to be balanced. In such instances the worker has to hold the tool to prevent it from being drawn upwards toward the upper arm. The force required will anyhow be much lower than the force required if no support at all is available.

The supporting device may further comprise weights, e.g. at the upper arm 13 for balancing the weight distribution of the device, e.g. for counteracting any downwardly rotational forces around the center of gravity of the supporting device. Further it may comprise support for any cables or the like to be connected to the hand-held tool.

The supporting device may, as indicated above, be used for suspending a great variety of heavier hand-held tools such as e.g. tools intended for welding, breaking, sawing cutting or the like.

In another embodiment of the present invention the line element 17 of FIG. 1 (such as a cord or a wire) is omitted and the hand-held tool is suspended directly in the loose end of the constant force spring. The spring may in this case optionally be mounted in the end of an upper arm from where the tool is to be suspended (not illustrated).

In yet another embodiment of the present invention cables attached to the hand-held tool may be provided with a hook or similar and the cables may be suspended in and supported by the inventive support device. In such a case a better access to interior operation areas, such as e.g. a car coupe, is enabled, as the line element in this case will not immediately limit the introduction of the tool (riot illustrated).

The inventive supporting device, as herein described, is simple, compact, reliable and easy and cheap to manufacture.

The present invention solves problems, which are associated with known art. It is, of course, not limited to the embodiments described above and shown in the drawings, but may be modified within the scope of the appended claims.

What is claimed is:

1. A device for supporting a heavier hand-held tool comprising a tool stand provided with a support arm arrangement mounted thereon, and a constant force spring having a first end and a second end, said first end of the constant force spring being attached to said support arm arrangement, and said hand-held tool being hung from said second end of the constant force spring, wherein the constant force of the spring is such that a user of the hand-held tool is relieved from at least a substantial portion of the weight of the tool, and the drawn-out length of the spring is long enough to enable the tool to be hung in a plurality of different operation heights.

2. The device as claimed in claim 1, wherein the constant force of the spring is such that the tool is hung substantially in a totally weight-balanced state.

3. The device as claimed in claim 1, wherein said constant force spring is comprised of a metallic band rolled around its first end, which is an inner ring-shaped end having an axis of symmetry and said second end of the constant force spring is an outer loose end of said band, wherein said ring-shaped end is attached to said support arm arrangement such that said ring-shaped end is freely rotatable around said axis of symmetry.

4. The device as claimed in claim 3, wherein said ring-shaped end of the constant force spring is attached to said support arm arrangement journalled in a bearing.

5. The device as claimed in claim 4, wherein said first end of the constant force spring is attached to an uppermost end of said support arm arrangement.

6. The device as claimed in claim 3, wherein said ring-shaped end of the constant force spring is attached to a shaft of said support arm arrangement such as to provide sufficient clearance between the shaft and the inner diameter of the ring-shaped end, to allow the free rotation around the axis of symmetry.

7. The device as claimed in claim 1, wherein said constant force spring is comprised of a metallic band rolled around its first end, which is an inner ring-shaped end having an axis of symmetry and said second end of the constant force spring is an outer end of said band, wherein said ring-shaped end is attached to said support arm arrangement such that said ring-shaped end is freely rotatable around said axis of symmetry as the band is drawn out, and wherein the tensile force of the spring is substantially independent of the deflection of the spring.

8. The device as claimed in claim 7, wherein said ring-shaped end of the constant force spring is attached to said support arm arrangement journalled in a bearing.

9. The device as claimed in claim 7, wherein said ring-shaped end of the constant force spring is attached to a shaft of said support arm arrangement such as to provide sufficient clearance between the shaft and the inner diameter of the ring-shaped end, to allow the free rotation around the axis of symmetry.

10. A device for supporting a heavier hand-held tool, particularly a machine-driven tool, optionally with cables attached to it, comprising a tool stand provided with a support arm arrangement mounted thereon, a constant force spring having a first end and a second end, and a line element having a first end and a second end, said first end of the constant force spring being attached to said support arm arrangement, and said second end of the constant force spring being attached to said first end of the line element, said hand-held tool being arranged to be suspended from said second end of the line element, wherein the constant force of the spring is such that a user of the hand-held tool, during use, is relieved from at least a substantial portion of the weight of the tool, and optionally of the cables attached to it, and the drawn-out length of the spring is long enough to enable the tool to be suspended in a plurality of different operation heights.

11. The device as claimed in claim 10, wherein the constant force of the spring is such that the tool is suspended effectively in a weight-balanced state.

12. The device as claimed in claim 10, wherein said support arm arrangement comprises a substantially horizontally arranged upper arm having (1) a first end to which said first end of the constant force spring is attached, and (2) a second end from which said second end of said line element is hanging, and wherein said substantially horizontally arranged upper arm is arranged for guiding the drawn-out length of the spring and the first end of said line element.

13. The device as claimed in claim 12, wherein said support arm arrangement comprises a housing provided with a substantially horizontal through bore for receiving said substantially horizontally arranged upper arm, and wherein said substantially horizontally arranged upper arm is movable along the axis of the bore.

14. The device as claimed in claim 13, wherein said support arm arrangement comprises a vertically extended support arm at which said housing is mounted such that said housing is rotatable around a substantially vertical axis.

15. The device as claimed in claim 14, wherein said vertically extended support arm is extending in a direction, which is inclined by 15–40° from the vertical direction.

16. The device as claimed in claim 10, wherein said tool stand is mounted on a trolley.

17. A device for supporting cables attached to a heavier hand-held tool, particularly a machine-driven tool, such as a spot welding gun intended to be used for e.g. plate works, comprising a tool stand provided with a support arm arrangement mounted thereon, a constant force spring having a first end and a second end, and a line element having a first end and a second end, said first end of the constant force spring being attached to said support arm arrangement, and said second end of the constant force spring being attached to said first end of the line element, said cables attached to the hand-held tool being arranged to be suspended from said second end of the line element, wherein the constant force of the spring is such that a user of the hand-held tool, during use, is relieved from at least a substantial portion of the weight of the cables attached to it, and the drawn-out length of the spring is long enough to enable the cables to be suspended in a plurality of different operation heights.

* * * * *